US012195898B2

(12) United States Patent
Natu et al.

(10) Patent No.: US 12,195,898 B2
(45) Date of Patent: Jan. 14, 2025

(54) FORMALDEHYDE-CONTAINING PRODUCTS WITH REDUCED FORMALDEHYDE EMISSIONS

(71) Applicant: JOHNS MANVILLE, Denver, CO (US)

(72) Inventors: Ameya Natu, Highlands Ranch, CO (US); Kiarash Alavi, Littleton, CO (US)

(73) Assignee: Johns Manville, Denver, CO (US)

( * ) Notice: Subject to any disclaimer, the term of this patent is extended or adjusted under 35 U.S.C. 154(b) by 231 days.

(21) Appl. No.: 17/318,430

(22) Filed: May 12, 2021

(65) Prior Publication Data

US 2022/0364283 A1 Nov. 17, 2022

(51) Int. Cl.
*D04H 1/64* (2012.01)
*D04H 1/4218* (2012.01)
*D04H 1/587* (2012.01)

(52) U.S. Cl.
CPC ..... *D04H 1/64* (2013.01); *D04H 1/4218* (2013.01); *D04H 1/587* (2013.01)

(58) Field of Classification Search
CPC ..... C08G 12/12; C08G 12/16; D04H 1/64; D04H 1/587; D04H 1/4218
See application file for complete search history.

(56) References Cited

U.S. PATENT DOCUMENTS 4,868,227 A * 9/1989 Kempter ..... C08G 6/02 523/222
5,017,641 A * 5/1991 Kempter ..... C08G 12/12 524/598
5,378,755 A * 1/1995 Krishnan ..... D06P 1/5257 524/558
6,194,512 B1 * 2/2001 Chen ..... C08L 61/06 524/611
2008/0248303 A1 * 10/2008 Maurer ..... D04H 1/587 427/292
2015/0086803 A1 * 3/2015 Srinivasan ..... B32B 38/0012 427/389.9
2021/0054171 A1 2/2021 Alavi et al.

FOREIGN PATENT DOCUMENTS

WO 2008005635 A2 1/2008
WO 2008124782 A1 10/2008

* cited by examiner

*Primary Examiner* — Jeremy R Pierce
(74) *Attorney, Agent, or Firm* — Robert D. Touslee

(57) ABSTRACT

Binder compositions are described that include at least one formaldehyde-containing compound, a cyclic urea-dialdehyde compound, and a polyamine compound. The polyamine compound may be selected from melamine and dicyandiamide. The weight ratio of the at least one formaldehyde-containing compound to the combined weight of the cyclic urea-dialdehyde compound and the polyamine compound may be greater than or about 1:1. As described are binder-containing fiberglass products that include glass fibers and a binder. The binder may include a formaldehyde polymer characterized by crosslinking with a cyclic urea-dialdehyde and a polyamine. The binder-containing fiberglass products have reduced formaldehyde emissions.

15 Claims, 6 Drawing Sheets

FORMALDEHYDE-CONTAINING PRODUCTS WITH REDUCED FORMALDEHYDE EMISSIONS

TECHNICAL FIELD

The present technology relates to composite products that include organic polymer binders. More specifically, the present technology relates to composite products that include formaldehyde-containing polymer binders with reduced formaldehyde emissions.

BACKGROUND

Formaldehyde-containing polymers have been used as binders in composite materials since the start of the plastics industry. Unfortunately, many formaldehyde-containing binders release free formaldehyde both during curing of the binder composition and from the products containing the cured binder. Thus, there is a need to develop formulations and methods that reduce the release of formaldehyde from binders that include formaldehyde-containing polymers. This and other problems are addressed in the present application.

BRIEF SUMMARY

The present technology includes binder compositions that include at least one formaldehyde-containing compound, a cyclic urea-dialdehyde compound, and a polyamine compound. The polyamine compound may be selected from melamine and dicyandiamide. The weight ratio of the at least one formaldehyde-containing compound to the combined weight of the cyclic urea-dialdehyde compound and the polyamine compound may be greater than or about 1:1.

In additional embodiments, the at least one formaldehyde-containing compound may be selected from phenol-formaldehydes, urea-formaldehydes, phenol-urea-formaldehydes, melamine formaldehydes, melamine-urea-formaldehydes, and resorcinol-formaldehydes.

In further embodiments, the cyclic urea-dialdehyde compound may have the formula:

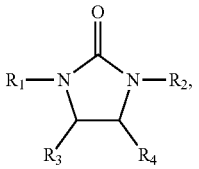

where $R_1$ and $R_2$ are independently selected from a hydrogen, a hydroxyl group, and an alcohol group, and where $R_3$ and $R_4$ are independently selected from a hydroxyl group and an alcohol group. In still further embodiments, the cyclic urea-dialdehyde compound may be 4,5-dihydroxyimidazoldin-2-one.

In yet additional embodiments, the binder composition may include a cure catalyst selected from diammonium sulfate and diammonium phosphate. In more embodiments, the binder composition is characterized by a free formaldehyde level of less than or about 11 wt. % based on a total weight of the binder composition. In still more embodiments, the binder composition is characterized by a pH of greater than or about 8.

The present technology further includes binder-containing fiberglass products that include glass fibers and a binder. The binder may include a formaldehyde polymer characterized by crosslinking with a cyclic urea-dialdehyde and a polyamine.

In additional embodiments, the formaldehyde polymer may be a phenol-urea-formaldehyde polymer. In further embodiments, the cyclic urea-dialdehyde may include 4,5-dihydroxyimidazoldin-2-one. In still additional embodiments, the polyamine may include dicyandiamide. In more embodiments, the binder-containing fiberglass products may be characterized by 23° C. formaldehyde emissions of less than or about 20 part-per-billion. In still more embodiments, the products may be characterized by a tensile strength of greater than or about 3.3 MPa.

The present technology additionally includes methods of making a binder-containing fiberglass product. The methods may include an operation to form a binder composition that includes a formaldehyde-containing compound, a cyclic-urea dialdehyde compound, and a polyamine compound. The methods may further include contacting the binder composition with glass fibers to make a binder-fiber amalgam. The binder-fiber amalgam may be heated to cure the binder composition and form a cured binder-fiber composite. The cured binder-fiber composite may be processed to form the binder-containing fiberglass product.

In additional embodiments, the formaldehyde-containing compound may be selected from phenol formaldehydes, urea formaldehydes, phenol-urea-formaldehydes, and melamine formaldehydes.

In further embodiments, the cyclic urea-dialdehyde compound may have the formula:

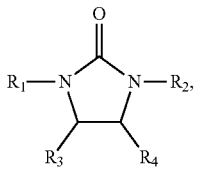

where $R_1$ and $R_2$ are independently selected from a hydrogen, a hydroxyl group, and an alcohol group, and where $R_3$ and $R_4$ are independently selected from a hydroxyl group and an alcohol group. In still further embodiments, the polyamine compound may be selected from melamine and dicyandiamide.

In more embodiments, the binder-fiber amalgam may be heated to a temperature of less than or about 260° C. In yet more embodiments, the binder-containing fiberglass product may be selected from a fiberglass insulation batt and a fiberglass mat.

Such technology may provide numerous benefits over conventional formaldehyde-containing binder compositions and the fiberglass-containing products made with the binder compositions. For example, embodiments of the binder compositions include combinations of cyclic urea-dialdehyde compounds and polyamine compounds that reduce formaldehyde emissions from the binder compositions to a greater extent than either type of compound could achieve by itself. The reduction in formaldehyde emissions also applies to the cured binders made with the binder compositions. In addition, the combination of the formaldehyde-containing compounds with both a cyclic urea-dialdehyde compound and a polyamine compound in the binder composition can improve the cure kinetics of the binder composition compared to conventional formaldehyde-containing binder compositions that include only one (or neither) of the compounds. Synergistic improvements are also measured in the mechanical properties of fiberglass-containing products made with the present binders compared to conventional fiberglass products that include only one (or neither) of the compounds. These and other embodiments, along with many of their advantages and features, are described in more detail in conjunction with the below description and attached figures.

BRIEF DESCRIPTION OF THE DRAWINGS

A further understanding of the nature and advantages of the disclosed technology may be realized by reference to the remaining portions of the specification and the drawings.

Figure 1A:
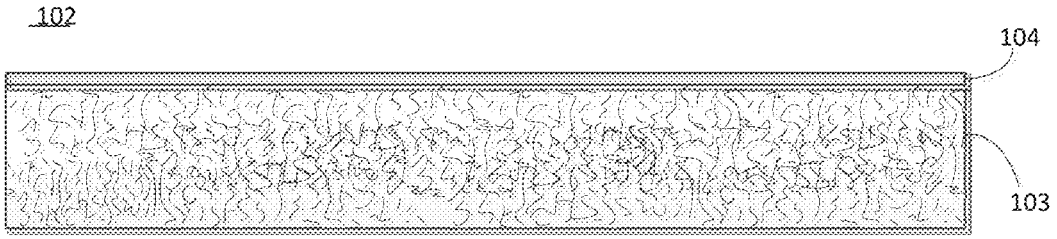
FIG. 1A, FIG. 1B, and FIG. 1C, show simplified illustrations of exemplary composite materials according to embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the letter.

DETAILED DESCRIPTION

Formaldehyde-containing binder compositions are used to make a variety of composite materials that include the cured formaldehyde binder and a reinforcement material such as glass fibers. Examples of these composite materials include formaldehyde-binder-containing fiberglass products for thermal insulation, facers, and reinforcement scrims, among other uses. Among other benefits, many formaldehyde-containing binders such as phenol-formaldehyde binders, urea-formaldehyde binders, phenol-urea-formaldehyde binders, and melamine-formaldehyde binders, have good mechanical properties and exceptional thermal stability. Their thermal stability makes them well suited in fiberglass insulation products placed in high-temperature environments like around hot pipes and ducts, and incorporated into articles designed for heating such as ovens and dishwashers, among other high-temperature uses.

Unfortunately, many formaldehyde-containing binder compositions release free-formaldehyde while the compositions are curing, and the cured products can continue to release formaldehyde for an extended period. High levels of formaldehyde emitted from the curing compositions is an irritant, and many jurisdictions have set emission limits on the levels of formaldehyde released from the cured products. In some cases, the rate of formaldehyde emissions can increase when the temperature of the composite product increases. In some instances, the increase in formaldehyde emissions caused by the increased temperature can approach the regulated emissions limits for the product. Thus, there is a need for new formaldehyde-containing binder composition formulations that have reduced levels of free formaldehyde and produce reduced formaldehyde emissions during curing operations and from the binder-containing products.

Embodiments of the present technology address problems with excessive formaldehyde emissions from formaldehyde-containing binder compositions and binder-containing products by including a combination of formaldehyde scavengers in the compositions. In embodiments, the combinations may include a cyclic urea-dialdehyde compound and a polyamine compound. The combination of formaldehyde scavengers has a synergistic effect that reduces formaldehyde emissions by a greater amount than an equivalent amount of either scavenger by itself. In embodiments, the additional reduction in formaldehyde emissions from the combined formaldehyde scavengers compared to the same amount of the individual scavenger can be greater than or about 5%, greater than or about 10%, greater than or about 15%, greater than or about 20%, greater than or about 25%, greater than or about 30%, or more.

In further embodiments, the combination of formaldehyde scavengers may also reduce or negate drawbacks with an individual scavenger. For example, the polyamine compound dicyandiamide can significantly slow the cure kinetics of phenol-formaldehyde and phenol-urea-formaldehyde binder compositions. In some instances, the addition of as little as 5 wt. % dicyandiamide to a phenol-formaldehyde binder composition can raise the cure temperature by greater than 30° C. In contrast, when dicyandiamide is combined with a cyclic urea-dialdehyde compound such as 4,5-dihydroxyimidazoldin-2-one, the cure kinetics of some phenol-formaldehyde and phenol-urea-formaldehyde binder compositions return to a dicyandiamide-free level or faster. In embodiments, these binder compositions have cure temperatures that are about the same or lower than phenol-formaldehyde and phenol-urea-formaldehyde binder compositions that lack dicyandiamide. However, the present binder compositions are also characterized by a reduction in formaldehyde emissions that is greater than conventional binder compositions that include dicyandiamide as the sole formaldehyde scavenger.

In another example, 4,5-dihydroxyimidazoldin-2-one as a sole formaldehyde scavenger can significantly reduce the unaged and humid-aged tensile strength of phenol-formaldehyde and phenol-urea-formaldehyde binders. In contrast, when dicyandiamide is combined with 4,5-dihydroxyimidazoldin-2-one the tensile strength of some phenol-formaldehyde and phenol-urea-formaldehyde binders return to or exceed the mechanical strength measured in phenol-formaldehyde and phenol-urea-formaldehyde binder compositions that lack 4,5-dihydroxyimidazoldin-2-one. However, the present phenol-formaldehyde and phenol-urea-formaldehyde binders that included the combination of a cyclic urea-dialdehyde and a polyamine are also characterized by a reduction in formaldehyde emissions that are greater than conventional binder compositions that include dicyandiamide as the sole formaldehyde scavenger. Additional details about embodiments of the binder compositions are discussed below.

Exemplary Binder Compositions

Embodiments of the formaldehyde-containing binder compositions may include phenol-formaldehyde (PF) binder compositions, phenol-urea-formaldehyde (PUF) binder compositions, urea-formaldehyde (UF) binder compositions, and melamine-formaldehyde (MF) binder compositions, among other formaldehyde-containing binder compositions. In embodiments, PF binder compositions may include resole binder compositions where the amount of formaldehyde (by mole) exceeds the amount of phenol. Phenol-to-formaldehyde mole ratios in these resole binder compositions range from 1:1 to 1:5 (e.g., 1:1.2 to 1:4.5; 1:1.5 to 1:2.5; etc.). In further embodiments, the PF binder compositions are aqueous compositions characterized by a total solids concentration greater than or about 30 wt. %, greater than or about 40 wt. %, greater than or about 50 wt. %, greater than or about 60 wt. %, or more.

In additional embodiments, the PF resole binders may be made by combining phenol, formaldehyde, and a base that catalyzes the reaction between the phenol and formaldehyde reactants. In further embodiments, the phenol and formaldehyde may be combined as aqueous solutions in a reactor and heated to a temperature of 40-50° C. (e.g., 45° C.) under mechanically agitated (e.g., stirred) conditions. A base catalyst may be introduced to the aqueous phenol and formaldehyde mixture over a period of 10-30 minutes. In embodiments, the base catalyst may include one or more alkali metal hydroxides such as sodium hydroxide and potassium hydroxide, one or more alkaline earth metal hydroxides such as magnesium hydroxide and calcium hydroxide, one or more carbonate salts such as sodium carbonate and potassium carbonate, one or more ammonium salts such as ammonium hydroxide, and/or one or more amines, among other kinds of base catalysts.

In embodiments, the addition of the base catalyst raises the pH of the aqueous phenol and formaldehyde mixture above pH 7 (e.g., pH of 7-10), and can be accompanied by a further increase in reactor temperature (e.g., 70° C.) for 1-2 hours (e.g., 90 minutes). Following this reaction period, the PF reaction mixture may be cooled to room temperature (e.g., 23° C.) and neutralized (e.g., pH 7.2-7.6) by adding an acid (e.g., an inorganic acid such as sulfuric acid). In further embodiments, a cyclic urea-dialdehyde compound and polyamine compound may be added directly to the PF reaction mixture to form the PF binder composition. In still further embodiments, the cyclic urea-dialdehyde and polyamine compounds may function as a formaldehyde scavengers and crosslinking agents in the PF binder composition. In additional embodiments one or both of the compounds may also function as cure catalyst that obviate the need to add other cure catalysts to the binder composition. In some of these embodiments, the PF binder composition may include one or more pre-cured phenol-formaldehyde compounds, the urea-dialdehyde and polyamine compounds, and any residual materials used in the making of the binder composition (e.g., base catalyst, acidifier, etc.). In additional embodiments, a cure catalyst may be added in an amount less than or about 5 wt. %, less than or about 4 wt. %, less than or about 3 wt. %, less than or about 2 wt. % less than or about 1 wt. %, or less.

In additional embodiments, phenol-urea-formaldehyde (PUF) binder compositions may be made by taking a PF binder composition, either made in situ or purchased commercially, and adding urea. Exemplary preparation methods include adding an aqueous urea solution (or prilled urea) to the PF binder under agitation. In embodiments, the urea may be added in an amount greater than or about 15 wt. %, amount greater than or about 20 wt. %, greater than or about 30 wt. %, greater than or about 40 wt. %, greater than or about 50 wt. %, or more, based on the weight of the phenol-formaldehyde present in the binder composition. In additional embodiments, the urea may be added in an amount representing a mole ratio of the urea to free formaldehyde in the PF mixture ranging from 1:1 to 1:1.75.

In embodiments, at least one cyclic urea-dialdehyde compounds and polyamine compound may be added to the PF binder composition with the urea during the making of the PUF binder composition. In additional embodiments, at least one cyclic urea-dialdehyde compounds and polyamine compound may be added before or after the introduction of the urea.

In further embodiments, ammonia may accompany the addition of urea in the PUF binder compositions. Aqueous ammonia solutions may be added before, during, or after the addition of urea to the PF binder composition. The amount of added ammonia may be measured as a weight percentage of the PF present in the composition (e.g., 1 wt. % to 3 wt. % of the PF amount). The added ammonia alternatively be measured by the change in pH of the PF or PUF binder composition. For example, ammonia and urea may be added to a starting PF composition until its pH increases to around 8.5 (e.g., pH range of 8.2 to 8.6, pH of 8.3, etc.).

In some embodiments, the PUF binder compositions may also include a cure catalyst. The cure catalyst is normally added at 0.1% to 5% by dry weight (e.g., 1% to 3% by dry weight) of the binder composition. Exemplary cure catalysts include ammonium and amino salts such as ammonium sulfate, ammonium bisulfate, ammonium phosphate, ammonium sulfamate, ammonium carbonate, ammonium acetate, and ammonium maleate.

In further embodiments, the urea-formaldehyde (UF) and melamine formaldehyde (MF) binder compositions may be made by combining formaldehyde and the urea or melamine reactants in an aqueous solution or mixture. In embodiments, the mole ratio of the urea or melamine to the formaldehyde may be greater than 1:1 in order to reduce the amount of free formaldehyde leftover after the binder has cured. In further embodiments, the mole ratio of urea or melamine to formaldehyde may be greater than or about 1:1, greater than or about 1.1:1, greater than or about 1.25:1, greater than or about 1.5:1, greater than or about 1.75:1, greater than or about 2:1, or more. In additional embodiments, the at least one cyclic urea-dialdehyde compounds and polyamine compound may be added to the UF or MF binder compositions with the urea or melamine during the making of the UF or MF binder compositions. In additional embodiments, at least one cyclic urea-dialdehyde compounds and polyamine compound may be added before or after the introduction of the urea or melamine.

In embodiments, present binder compositions may also contain one of more of lubricants (e.g., a mineral oil), thickening and rheology control agents, dyes, and silane coupling agents (e.g., an amino alkyl alkoxysilane such as 3-aminopropyl triethoxysilane). When these processing aids are added to the binder composition, they are typically added at less than or about 5 wt. %, less than or about 4 wt. %, less than or about 3 wt. %, less than or about 2 wt. %, less than or about 1 wt. %, or less, based on the dry weigh of the binder composition.

Unless otherwise indicated, the concentrations of the components of the binder compositions are a dry weight percentage that excludes the weight of a binder solvent. In many embodiments, the present binder compositions are aqueous, and the binder solvent is water. In some embodiments, the binder composition is a colorless aqueous solution. The relative concentration of binder solids in the solvent (i.e. total solids) may range from about 5 wt. % to about 75 wt. % based on the total weight of the binder composition. More specific ranges of the total solids include about 5 wt. % to about 50 wt. %; about 10 wt. % to about 70 wt. %; about 10 wt. % to about 40 wt. %; about 30 to about 60 wt. %; about 40 to about 50 wt. %, among other ranges. Specific exemplary total solids concentrations based on the weight of the binder composition include about 10 wt. %, about 15 wt. %, about 20 wt. %, about 25 wt. %, about 30 wt. %, about 35 wt. %, about 40 wt. %, about 45 wt. %, about 50 wt. %, about 55 wt. %; about 60 wt. %; about 65 wt. %; about 70 wt. %; and about 75 wt. %, among other concentrations.

Exemplary Cyclic Urea-Dialdehyde Compounds

As noted above, embodiments of the present binder composition include at least one cyclic urea-dialdehyde compound and at least one polyamine compound. In embodiments, the cyclic urea-dialdehyde compounds may be formed as reaction products of (i) a urea compound with (ii) an aldehyde and/or ketone containing compound. The urea compound may be a substituted our unsubstituted urea having the Formula (I):

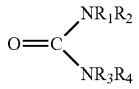

(I)

where $R_1$, $R_2$, $R_3$, and $R_4$ are independently chosen from a hydrogen moiety (H), an alkyl group, an aromatic group, an alcohol group, an aldehyde group, a ketone group, a carboxylic acid group, and an alkoxy group. Exemplary alkyl groups include straight-chained, branched, or cyclic hydrocarbons of varying size (e.g., $C_1$-$C_{12}$, $C_1$-$C_8$, $C_1$-$C_4$, etc.). Exemplary aromatic (i.e., aryl) groups include substituted or unsubstituted phenyl moieties, among other aromatic constituents. Exemplary alcohol groups include —ROH, where R may be a substituted or unsubstituted, saturated or unsaturated, branched or unbranched, cyclic or acyclic, organic moiety. For example, R may be —$(CH2)_n$-, where n may be 1 to 12. Exemplary alcohols may also include polyols having two or more hydroxyl groups (—OH) in alcohol group. Exemplary aldehyde groups include —RC(═O)H, where R may be a monovalent functional group (e.g., a single bond), or a substituted or unsubstituted, saturated or unsaturated, branched or unbranched, cyclic or acyclic, organic moiety, such as —$(CH2)_n$—, where n may be 1 to 12. Exemplary ketone groups may include —RC(═O)R' where R and R' can be variety of carbon containing constituents. Exemplary carboxylic acid groups may include —R—COOH, where R may be a monovalent functional group, such as a single bond, or a variety of carbon-containing constituents. Exemplary alkoxy groups include —$OR_x$, where $R_x$ is an alkyl group.

The aldehyde reactant may include dialdehyde and/or diketone containing compounds may include polyaldehydes (e.g., dialdehydes), polyketones (e.g., diketones), and compounds that have at least two aldehyde groups or at least two ketone groups. Examples include α,β-bicarbonyl compounds where carbonyl carbons are directly bonded as illustrated in the following Formula (II):

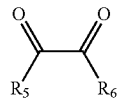

(II)

where $R_5$ and $R_6$ are independently chosen from a hydrogen moiety (H), an alkyl group, or an aromatic group. Exemplary α,β-carbonyl compounds include glyoxal, diacetyl, and benzil (i.e., 1,2-diphenylethane-1,2-dione).

Examples further include α,γ-bicarbonyl compounds where the carbonyl carbons are separated by one carbon atom as illustrated in the following Formula (III):

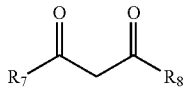

(III)

wherein $R_7$ and $R_8$ are independently chosen from a hydrogen moiety (H), an alkyl group, or an aromatic group. Exemplary α,γ-bicarbonyl compounds include malonaldehyde, and acetylacetone. In some instances, the $R_7$ and $R_8$ groups may independently also include alkoxide groups (—OR) where R represents an alkyl group, and amine groups (—NR'R"), where R' and R" independently represent a hydrogen moiety (H) or an alkyl group. For example, the α,γ-bicarbonyl compounds may include malonic acid esters having Formula (IV):

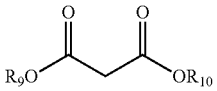

(IV)

where $R_9$ and $R_{10}$ are independently an alkyl group or an aromatic group.

Additional examples of α,γ-bicarbonyl compounds may include those with amide moieties such as those illustrated in Formula (V):

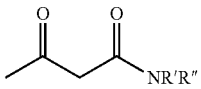

(V)

where R' and R" are independently a hydrogen moiety (H) or an alkyl group.

Additional examples of α,γ-bicarbonyl compounds may further include those with alkoxy moieties such as those illustrated in Formula (VI):

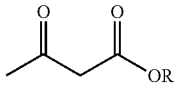

(VI)

where R represents an alkyl group.

Exemplary aldehyde and/or ketone containing compounds may include aldehyde-containing compounds having one or more (e.g., two or more) aldehyde functional groups. Examples of these aldehyde-containing compounds include acetaldehyde, propanaldehyde, butyraldehyde, acrolein, furfural, glyoxal, glutaraldehyde, and polyfurfural among others. Exemplary aldehyde-containing compounds may also include substituted glyoxal compounds having Formula (VII):

(VII)

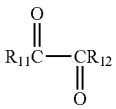

where $R_{11}$ and $R_{12}$ may be independently hydrogen (H), an alkyl group, an aromatic group, an alcohol group, an aldehyde group, a ketone group, a carboxylic acid group, and an alkoxy group, among other groups.

The reaction products of the urea compound and the aldehyde and/or ketone containing compound depend on the types of compounds selected, as well as the mole ratio of each compound. For example, when the urea compound is urea and the aldehyde and/or ketone containing compound is glyoxal in a 1:1 mole ratio, the predominant reaction product is 4,5-dihydroxyimidazolidin-2-one (i.e., DHEU) represented by Formula (VIII):

(VIII)

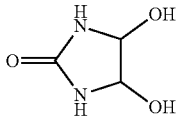

However, when excess urea increases the mole ratio of urea-to-glyoxal to 2:1, the predominant reaction product becomes a glycoluryl compound shown in Formula (IX):

(IX)

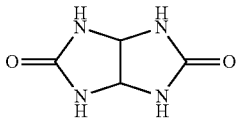

Alternatively, when excess glyoxal shifts the mole ratio of urea-to-glyoxal to 1:2, the predominant reaction product becomes a (2R,3S,6R)-2,3,5,6-tetrahydroxy-1,4-diazabicyclo[2.2.1]heptan-7-one compound shown in Formula (X):

(X)

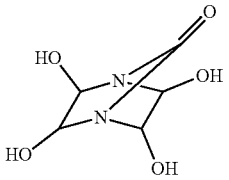

The reaction products of the urea compound and an aldehyde-containing compound having about a 1:1 mole ratio may include imidazolidine compounds of the Formula (XI):

(XI)

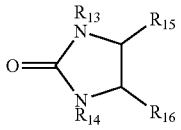

where $R_{13}$, $R_{14}$, $R_{15}$, and $R_{16}$ are independently, —H, —OH, —$NH_2$, an alkyl group, an aromatic group, an alcohol group, an aldehyde group, a ketone group, a carboxylic acid group, and an alkoxy group. As noted above, when the reactants are urea and glyoxal, the reaction product may be 4,5-dihydroxyimidazolidin-2-one as shown in Formula (VIII).

Additional examples of reaction products of a urea compound with an aldehyde and/or ketone containing compound may include the reaction products of the above-described α,β-bicarbonyl compounds and α,γ-bicarbonyl compounds as represented by Formulas (XII)-(XVII) below:

(XII)

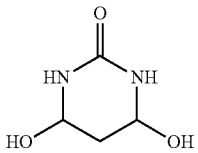

(XIII)

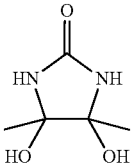

(XIV)

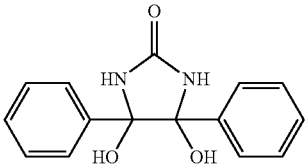

(XV)

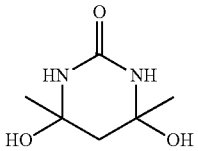

(XVI)

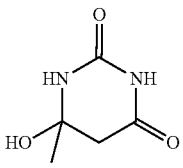

-continued (XVII)

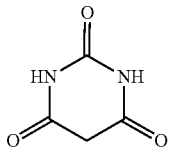

Exemplary Curd Binders

In embodiments, the combination of at least one formaldehyde-containing compound with a cyclic urea-dialdehyde compound and polyamine compound such as melamine and dicyandiamide forms a cured binder with a higher density of crosslinking and lower free formaldehyde emissions than formaldehyde-containing binder compositions that lack a cyclic urea-dialdehyde compound and polyamine compound. In further embodiments, one or both of the cyclic urea-dialdehyde compound and polyamine compound react with methylol groups in the formaldehyde-containing backbone polymers. These reactions between the cyclic urea-dialdehyde compounds (and/or polyamine compounds) and the methylol groups increase the crosslinking density in the cured binder while reducing the number of reversible reactions between pairs of methylol groups. Reducing the number of reversible methylol-methylol reactions reduces a source of free formaldehyde emissions when these ether-linked reaction products revert to methylene groups and free formaldehyde.

In embodiments, cured binders made according to embodiments of the present technology from at least one formaldehyde-containing compound, at least one a cyclic urea-dialdehyde compound, and at least one polyamine compound may have a higher crosslinking density than conventional cured binders made from the same formaldehyde-containing compound without the cyclic urea-dialdehyde compound and polyamine compound. In further embodiments, the present cured binders may have an increased crosslinking density compared to a conventional cured binder without a cyclic urea-dialdehyde compound and polyamine compound that is greater than or about 1%, greater than or about 2%, greater than or about 5%, greater than or about 7.5%, greater than or about 10%, greater than or about 12.5%, greater than or about 15%, greater than or about 17.5%, greater than or about 20%, greater than or about 22.5%, greater than or about 25%, or more.

In additional embodiments, the cured binders made according to embodiments of the present technology from at least one formaldehyde-containing compound, at least one a cyclic urea-dialdehyde compound, and at least one polyamine compound may have a lower amount of formaldehyde emissions than conventional cured binders made from the same formaldehyde-containing compound without the cyclic urea-dialdehyde compound and polyamine compound at the same aging times and conditions. In still further embodiments, the present cured binders may have formaldehyde emissions that are less than or about 95%, less than or about 90%, less than or about 85%, less than or about 80%, less than or about 75%, less than or about 70%, less than or about 65%, less than or about 60%, less than or about 55%, less than or about 50%, or less, at the same aging times and conditions, compared to conventional cured binders that lack a cyclic urea-dialdehyde compound and polyamine compound.

Exemplary Fiberglass-Containing Products

Embodiments of the present technology also include fiberglass-containing products made with the present binder compositions. In embodiments, the fiberglass-containing products may include woven or non-woven glass fibers bound together by a cured matrix of the binder. In additional embodiments, the fiberglass-containing products may include one or more additional types of fibers such as carbon fibers, mineral fibers, stone wool fibers, and organic polymer fibers, among other kinds for fibers. In embodiments, the fibers may make up about 50 wt. % to about 99.5 wt. % of the fiberglass-containing products. Additional exemplary fiber weight ranges include about 90 wt. % to about 99 wt. %; and about 75 wt. % to about 95 wt %. At the conclusion of the curing stage, the cured binder may be a water-insoluble, thermoset binder present as a secure coating on the fiber mat at a concentration of approximately 0.5 to 50 percent by weight of the product, for example the cured binder may be present at concentration of approximately 1 to 10 percent by weight of the product. Additional exemplary ranges of the cured binder (as a weight percentage of fiber-containing composite) may include at least about 1 wt. %; at least about 2 wt. %; at least about 3 wt. %; at least about 4 wt. %; at least about 5 wt. %; about 1 wt. % to about 25 wt. %; about 3 wt. % to about 25 wt. %; about 3 wt. % to about 15 wt. %; among other ranges. Specific exemplary amounts of the cured binder as a percentage weight of the fiberglass-containing product may include about 3 wt. %, about 5 wt. %, about 6 wt. %, about 7 wt. %, about 8 wt. %, about 9 wt. %, about 10 wt. %, about 11 wt. %, about 12 wt. %, about 13 wt. %; about 14 wt. %; about 15 wt. %; about 20 wt. %; and about 25 wt. %, among other amounts.

The fiberglass-containing products may take a variety of forms, for example construction materials including piping insulation, duct boards (e.g., air duct boards), and building insulation, reinforcement scrim, and roofing membranes, among other construction materials. Additional examples may include duct liner, duct wrap, flexible duct media, pipe insulation, tank insulation, rigid plenum liner, textile duct liner insulation, equipment liner, oven insulation, elevated temperature board, elevated temperature wrap, elevated temperature panel, insulation batts and rolls, heavy density batt insulation, light density batt insulation, exterior foundation insulation board, and marine hull insulation, among other materials.

The fibers and binder composition, along with the processing conditions, may be selected to produce fiber-containing composites with desired physical properties and aging characteristics. For example, when the fiberglass-containing product is a thermal insulation batt, the ordinary (i.e., unweathered) parting strength may be at least about 120 g/g (e.g., at least about 150 g/g). An exemplary range for the ordinary parting strength may be about 120 g/g to about 400 g/g. The weathered parting strength may also be at least about 120 g/g (e.g., at least about 150 g/g), where weathered parting strength is measured after fiberglass-containing product has been subjected to elevated temperature (e.g., about 120° F. or more) and humidity (e.g., about 95% or more relative humidity) for a period of time (e.g., about 7 days, about 14 days, etc.). An exemplary range for the weathered parting strength may be about 120 g/g to about 400 g/g.

Additional physical properties of the fiberglass-containing products may include a density that range of about 5 $kg/m^3$ to about 100 $kg/m^3$. More specific density ranges may include about 5 $kg/m^3$ to about 20 $kg/m^3$; and about 10 $kg/m^3$ to about 80 $kg/m^3$, among other density ranges. Specific exemplary densities of a the fiberglass-containing products may include about 5 $kg/m^3$; about 10 $kg/m^3$; about 15 $kg/m^3$; about 20 $kg/m^3$; about 25 $kg/m^3$; about 30 $kg/m^3$;

about 35 kg/m$^3$; about 40 kg/m$^3$; about 45 kg/m$^3$; about 50 kg/m$^3$; about 55 kg/m$^3$; about 60 kg/m$^3$; about 65 kg/m$^3$; about 70 kg/m$^3$; about 75 kg/m$^3$; and about 80 kg/m$^3$, among other densities. Densities for the fiberglass-containing products may vary depending on the type of product made. For example, when the fiberglass-containing product is a thermal insulation batt, a density range of about 4 kg/m$^3$ to about 12 kg/m$^3$ is common, although not the only density range. When the fiberglass-containing product is duct board, a density range of about 30 kg/m$^3$ to about 100 kg/m$^3$ is more typical, although again not the only density range.

The fiberglass-containing products may have a thermal conductivity, A, of less than 0.05 W/mK. An exemplary range of the thermal conductivity for the fiberglass-containing products may include about 0.02 W/mK to about 0.05 W/mK.

Fiberglass-containing products that are thermal insulation batts may have an ordinary (i.e., unweathered) rigidity, as measured by droop level, of about 3 inches or less (e.g., 2.5 inches or less). They may have a weathered droop level of about 5 inches or less (e.g., about 3.5 inches or less). The composites may also have an ordinary recovery level after compression of about 6 inches or more (e.g., 6.5 inches or more). They may have a weathered recovery level of about 5 inches or more (e.g., about 6 inches or more). The droop levels and recovery level ranges may vary depending on the type of fiber-containing composite. For example, a fiberglass-containing product that is duct board may have an ordinary recovery level of about 0.9 inches to about 1.1 inches (although this is not the only range of thickness recovery for duct board).

The fiberglass-containing products may be made to limit the amount of volatile organic compounds (VOCs) emitted from the composites. Exemplary levels of VOC emissions from the fiber-containing composites may be about 1 lb/hour or less (e.g., about 0.8 lb/hour or less).

As noted above, the fibers in the fiberglass-containing products may make up about 50 wt. % to about 99.5 wt. % of the products, with most of the remaining weight being the cured binder. Because the cured binder will burn off the product when it is exposed to intense heat and flame, the loss of weight on ignition of the composite (LOI) may range from about 0.5 wt. % to about 50 wt. %. Additional LOI ranges may be from about 1 wt. % to about 10 wt. %; about 2 wt. % to about 10 wt. %; and about 3 wt. % to about 6 wt. %, among other LOI ranges. LOIs for the fiberglass-containing product may vary depending on the type of product made. For example, when the fiberglass-containing product is a thermal insulation batt, an exemplary LOI range may be about 1 wt. % to about 10 wt. % (although this is not the exclusive range). When the fiberglass-containing product is duct board, a typically LOI range may be about 15 wt. % to about 22 wt. % (although again this is not the exclusive range).

The fiberglass-containing products may be water-resistant. Exemplary levels of water absorption in the composites may be about 0.5 wt. % or less, based on the weight of the product. The fiberglass-containing products may also generate reduced levels of particles during transport and installation. For example, when the fiberglass-containing product is thermal insulation batt, it may generate dust levels of about 10 grams to about 50 grams per 10,000 ft$^2$ of the composite. When the fiberglass-containing product is duct board, it may generate dust levels of about 0.03 grams to about 3 grams per pound of the duct board.

Figure 1B:
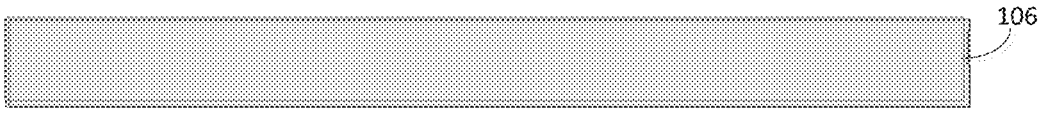
Figure 1C:
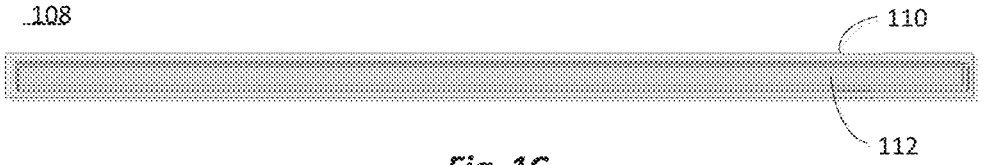

FIG. 1A-C illustrate some of these exemplary fiberglass-containing products. FIG. 1A is a simplified schematic of an exemplary fiberglass-containing batt material 102 that may be used for building, duct, pipe, or part insulation. The material 102 may include a batt 103 of non-woven fibers held together by the binder. The fibers include glass fibers that are used to make the fiberglass insulation (e.g., low-density or high-density fiberglass insulation), or a blend of two or more types of fibers, such as a blend of glass fibers and organic polymer fibers, among other types of fibers. In some examples, a facer 104 may be attached to one or more surfaces of the batt 103. Exemplary thicknesses of the batt 103 may range from about 1 cm to about 40 cm (e.g., about 2 cm to about 30 cm).

FIG. 1B is a simplified schematic of an exemplary fiberglass-containing composite board 106 that may be used as an insulation board, duct board, elevated temperature board, etc. The fibers in board 106 include glass fibers, and may also include one or more types of additional fibers such as organic polymer fibers, carbon fibers, mineral fibers, metal fibers, among other types of fibers, and blends of two or more types of these fibers.

FIG. 1C is a simplified schematic of an exemplary fiberglass-containing flexible insulation material 108 that may be used as a wrap and/or liner for ducts, pipes, tanks, equipment, etc. The fiberglass-containing flexible insulation material 108 may include a facer 110 attached to one or more surfaces of the fiber material 112. Exemplary materials for the facer 110 may include fire-resistant foil-scrim-kraft facing.

Specific examples of fiberglass-containing composites that use the present binder compositions include thermal, thermoset insulation batts, such as low-density fiberglass insulation batt (e.g., less than about 0.5 lbs/ft$^3$) and high-density fiberglass insulation batt. Additional examples include piping insulation, duct boards, duct liner, duct wrap, flexible duct media, pipe insulation, tank insulation, rigid plenum liner, textile duct liner insulation, equipment liner, oven insulation, elevated temperature board, elevated temperature wrap, elevated temperature panel, insulation rolls, exterior foundation insulation board, and marine hull insulation.

Exemplary Systems for Making Fiberglass Products

Figure 2:
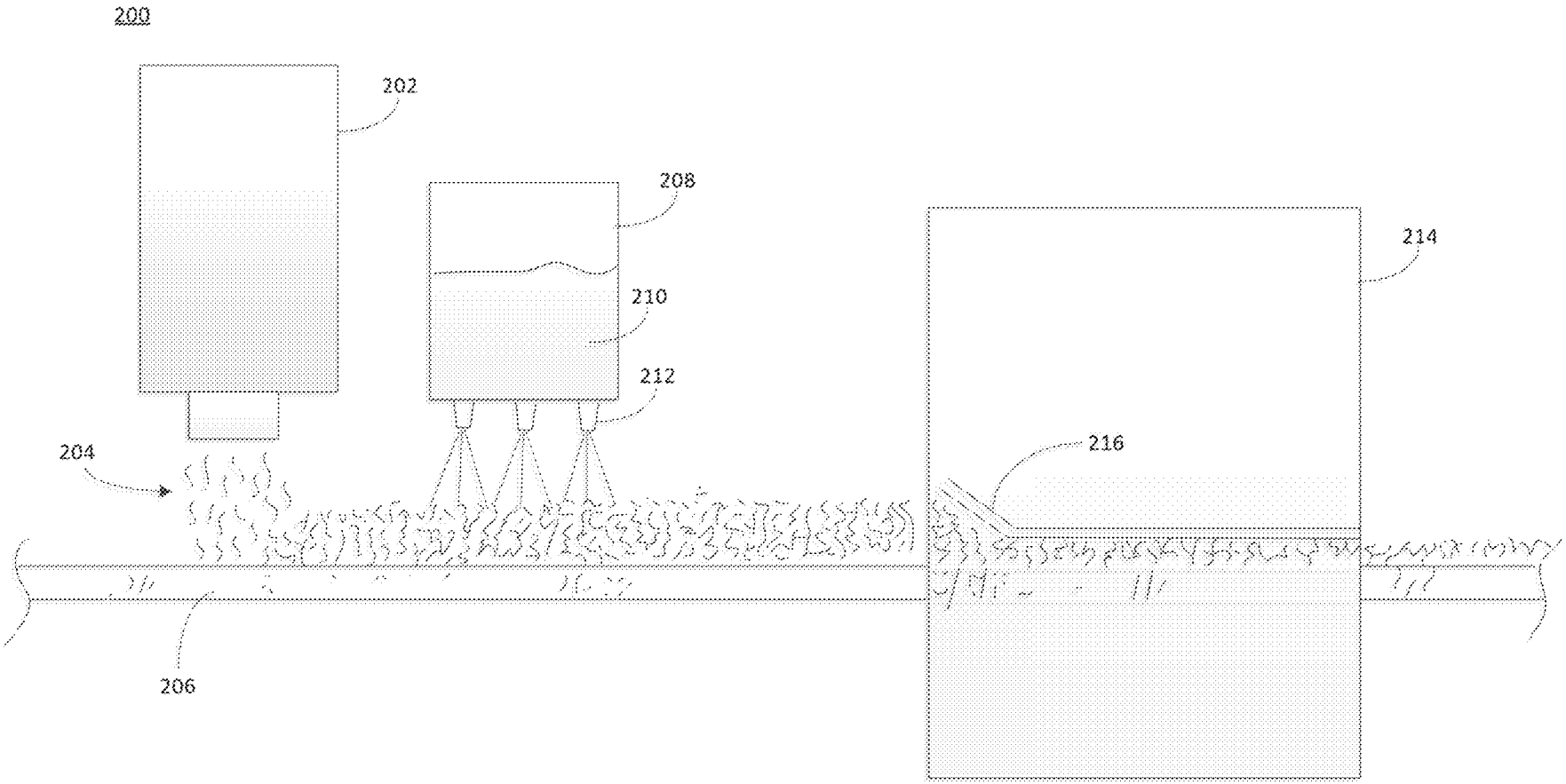
FIG. 2 shows a simplified schematic of an exemplary system for making fiberglass products according to embodiments of the present technology.

FIG. 2 shows a simplified schematic of an exemplary fabrication system 200 for making the fiberglass products described above. The system 200 includes fiber supply unit 202 that supplies the glass fibers for the product. The fiber supply unit 202 may be filled with pre-made glass fibers, or may include equipment for making the glass fibers from starting materials (e.g., molten glass). The fiber supply unit 202 deposits the fibers 204 onto a porous conveyor belt 206 that transports the fibers under the binder supply unit 208.

The binder supply unit 208 contains a liquid uncured binder composition 210, that is deposited onto the fibers 204. In the embodiment shown, the binder composition 210 is spray-coated onto the fibers 204 with spray nozzles 212, however, other application techniques (e.g., curtain coating, dip coating, knife coating, etc.) may be used in addition to (or in lieu of) the spray coating technique illustrated by nozzles 212.

The binder composition 210 applied on fibers 204 forms a fiber and binder amalgam on the top surface of the conveyor belt 206. The belt 206 may be perforated and/or porous to allow excess binder composition 210 to pass through the belt 206 to a collection unit (not shown) below. The collection unit may include filters and circulation pumps to recycle at least a portion of the excess binder back to the binder supply unit 208.

The conveyor belt 206 transports the amalgam to an oven 214 where it is heated to a curing temperature and the binder composition starts to cure. The temperature of the oven 214 and the speed of the conveyor belt 206 can be adjusted to control the curing time and temperature of the amalgam. In some instances, process conditions may set to completely cure the amalgam into the fiberglass composite. In additional instances, process conditions may be set to partially cure the amalgam into a B-staged composite.

The amalgam may also be compressed prior to or during the curing stage. System 200 shows an amalgam being compressed by passing under a plate 216 that tapers downward to decrease the vertical space available to the curing amalgam. The amalgam emerges from under the plate 216 in a compressed state and has less thickness than when it first made contact with the plate. The taper angle formed between the plate 216 and conveyor belt 206 can be adjusted to adjust the level of compression placed on the amalgam. The partially or fully cured product that emerges from under plate 216 can be used for a variety of applications, including construction materials such as pipe, duct, and/or wall insulation, among other applications.

Exemplary Methods of Making Fiberglass Insulation Products

Figure 3:
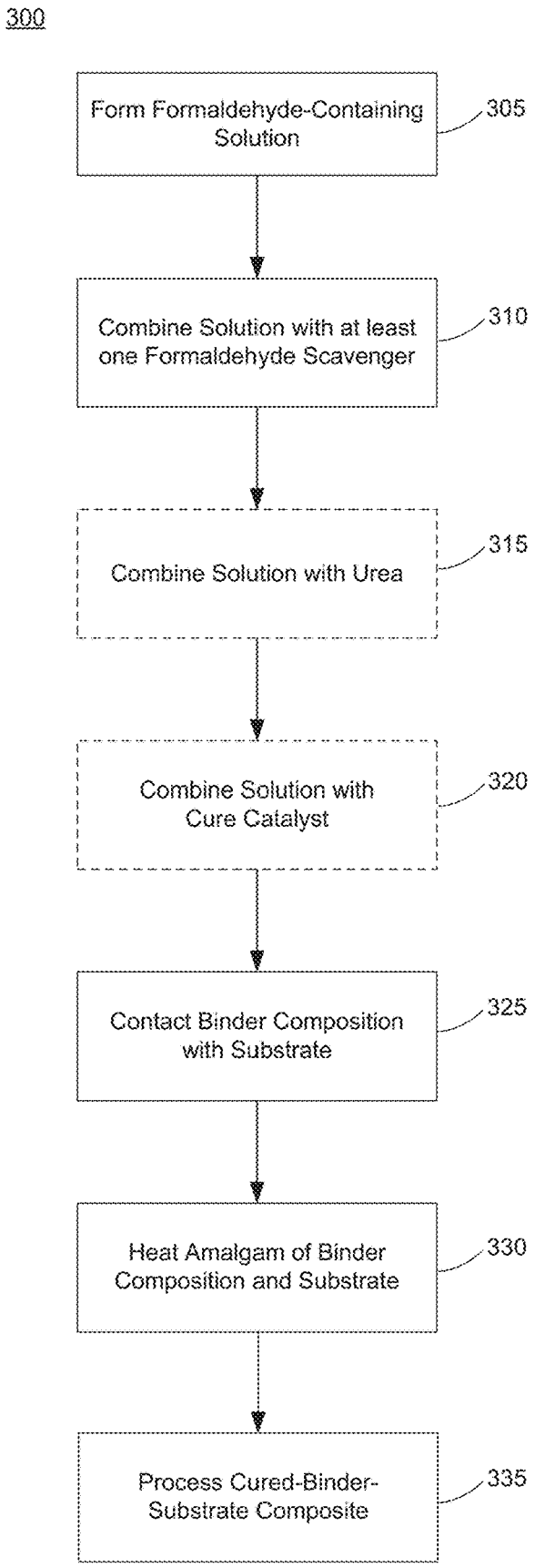
FIG. 3 is a flowchart that highlights some of the operations in a method of making a fiberglass product according to embodiments of the present technology.

FIG. 3 is a flowchart that highlights some of the operations in a method 300 of making a fiberglass product according to embodiments of the present technology. In embodiments, the method 300 may include forming a formaldehyde-containing solution (sometimes referred to as a raw resin) at operation 305. In further embodiments, the formaldehyde-containing starting solution may include formaldehyde combined with at least one compound selected from phenol, urea, and melamine. In still further embodiments, the formaldehyde-containing starting solution may be a phenol formaldehyde solution, a urea formaldehyde solution, a phenol-urea-formaldehyde solution, or a melamine formaldehyde solution. In yet additional embodiments, the formaldehyde-containing solution may be an aqueous solution with a total solids concentration of less than or about 60 wt. %, less than or about 55 wt. %, less than or about 50 wt. %, less than or about 45 wt. %, less than or about 40 wt. %, or less. In more embodiments, the formaldehyde-containing solution may include free formaldehyde in an amount less than or about 15 wt. %, less than or about 12.5 wt. %, less than or about 10 wt. %, less than or about 7.5 wt. %, less than or about 5 wt. %, or less.

In additional embodiments, method 300 may further include combining the formaldehyde-containing solution with at least one formaldehyde scavenger at operation 310. In embodiments, the formaldehyde scavenger may include at least one polyamine compound. In further embodiments, the polyamine compound may be at least one of dicyandiamide and melamine, among other polyamines. In further embodiments, the polyamine may be added at a weight percentage of the total solids in the binder composition that is less than or about 50 wt. %, less than or about 45 wt. %, less than or about 40 wt. %, less than or about 35 wt. %, less than or about 30 wt. %, less than or about 25 wt. %, less than or about 20 wt. %, less than or about 15 wt. %, less than or about 10 wt. %, less than or about 5 wt. %, or less. In more embodiments, the at least one formaldehyde scavenger may include at least one cyclic urea-dialdehyde compound. In still more embodiments, the cyclic urea-dialdehyde compound may be added at a weight percentage of the total solids in the binder composition that is less than or about 50 wt. %, less than or about 45 wt. %, less than or about 40 wt. %, less than or about 35 wt. %, less than or about 30 wt. %, less than or about 25 wt. %, less than or about 20 wt. %, less than or about 15 wt. %, less than or about 10 wt. %, less than or about 5 wt. %, or less.

In further embodiments, the at least one formaldehyde scavenger combined with the formaldehyde-containing solution at operation 310 may include at least one cyclic urea-dialdehyde compound and at least one polyamine compound. In still further embodiments, the weight percentage ratio of the cyclic urea-dialdehyde compounds to the polyamine compounds in the binder composition may be less than or about 75:25, less than or about 70:30, less than or about 65:35, less than or about 60:40, less than or about 55:45, less than or about 50:50, less than or about 45:55, less than or about 40:60, less than or about 35:65, less than or about 30:70, less than or about 25:75, or less. In embodiments, the weight percentage ratio of cyclic urea-dialdehyde compounds to the polyamine compounds may depend on the type of formaldehyde-containing compounds are in the binder composition. In some embodiments of phenol-formaldehyde and phenol-urea-formaldehyde binder compositions characterized by higher cure temperatures (e.g., greater than or about 170° C.), a higher weight percentage of cyclic urea-formaldehyde to polyamine may be used to maintain a low cure temperature of the phenol-and-formaldehyde-containing binder composition. In additional embodiments of urea-formaldehyde binder compositions that are phenol free and characterized by lower cure temperatures (e.g., less than or about 130° C.), a higher weight percentage of polyamine to cyclic urea-formaldehyde may be used to maintain low levels of formaldehyde emissions from the curing UF binder composition and cured binder.

In further embodiments, method 300 may optionally include combining the formaldehyde-containing solution with urea at operation 315. In embodiments, the formaldehyde-containing solution may include phenol and formaldehyde, and the urea may be added to form a phenol-urea-formaldehyde (PUF) binder composition (also sometimes referred to as a PUF "pre-react"). In additional embodiments, the weight percentage ratio of phenol and formaldehyde relative to the added urea may be greater than or about 50:50, greater than or about 55:45, greater than or about 60:40, greater than or about 65:35, greater than or about 70:30, or more. In yet additional embodiments, the added urea may be premixed with the at least one formaldehyde scavenger in a combined operation 310 and 315. In other embodiments, the urea may be added before the at least one additional formaldehyde scavenger is added at operation 310. In still other embodiments, the urea may be added after the formaldehyde-containing solution is combined with the at least one formaldehyde scavenger at operation 310.

In yet further embodiments, method 300 may optionally include combining the formaldehyde-containing solution with a cure catalyst at operation 320. In embodiments, the cure catalyst may include an inorganic catalyst. In additional embodiments, the inorganic catalyst may include an inorganic ammonium-ion-containing catalyst. In still additional embodiments, the inorganic ammonium-ion-containing catalyst may be at least one of diammonium sulfate and diammonium phosphate. In further embodiments, the cure catalyst may be at a weight percentage of the total solids in the binder composition that is less than or about 5 wt. %, less than or about 4.5 wt. %, less than or about 4 wt. %, less than or about 3.5 wt. %, less than or about 3 wt. %, less than or about 2.5 wt. %, less than or about 2 wt. %, or less. In embodiments, the addition of a cure catalyst may depend on the cure temperature of the binder composition without a cure catalyst. In some embodiments, phenol-free urea-formaldehyde binder compositions may be characterized by low cure temperatures (e.g., less than or about 130° C.) and may be free of a cure catalyst. In additional embodiments, a phenol-containing formaldehyde binder composition such as PF and PUF may be characterized by higher cure temperatures (e.g., greater than or about 170° C.) and may include at least one cure catalyst.

In embodiments, the combination of the formaldehyde-containing solution with the at least one formaldehyde scavengers, optional urea, and optional cure catalyst, among other binder compounds, may form the formaldehyde-containing binder composition. In additional embodiments, the binder composition may be characterized by a pH greater than or about 8, greater than or about 8.25, greater than or about 8.5, greater than or about 8.75, greater than or about 9, greater than or about 9.25, greater than or about 9.5, or more. In some embodiments of the binder compositions, premature polymerization may occur if the pH gets too low before the binder has cured. In these embodiments, an alkaline compound may be added to increase the pH of the binder composition. In embodiments, the alkaline compound added to the binder composition may be an inorganic hydroxide compound. In further embodiments, the inorganic hydroxide compound may be ammonium hydroxide. In yet further embodiments, the ammonium concentration may be at a weight percentage of the total solids in the binder composition that is less than or about 30 wt. %, less than or about 25 wt. %, less than or about 20 wt. %, less than or about 15 wt. %, less than or about 10 wt. %, less than or about 5 wt. %, or less.

Method 300 may further include contacting the formaldehyde-containing binder composition with a substrate at operation 325. In embodiments, the formaldehyde-containing binder composition may contact the substrate by spraying, curtain coating, spin coating, or dip coating, among other contacting techniques. In further embodiments, the substrate may be a fiberglass batt, a fiberglass mat, cellulose fibers, or a pressed cellulose board, among other kinds of substrate.

Method 300 may still further include heating the amalgam of the binder composition and the substrate to cure the binder composition at operation 330. In embodiments, the amalgam may be heated to a curing temperature greater than or about 125° C., greater than or about 130° C., greater than or about 135° C., greater than or about 140° C., greater than or about 145° C., greater than or about 150° C., greater than or about 155° C., greater than or about 160° C., greater than or about 165° C., greater than or about 170° C., greater than or about 175° C., greater than or about 180° C., greater than or about 185° C., greater than or about 190° C., greater than or about 195° C., greater than or about 200° C., or more. In additional embodiments, the amalgam may be heated to a curing temperature that is greater than or about the binder composition's cure temperature.

In embodiments, the amalgam of the curing binder composition and the substrate may be held at the curing temperature for greater than or about 1 minute, greater than or about 2 minutes, greater than or about 3 minutes, greater than or about 4 minutes, greater than or about 5 minutes, greater than or about 6 minutes, greater than or about 7 minutes, greater than or about 8 minutes, greater than or about 9 minutes, greater than or about 10 minutes, or more. In further embodiments, the end of the curing time may produce a cured binder-substrate composite.

Method 300 may yet further include processing the cured binder-substrate composite at operation 335. In embodiments, the processing operation 330 may include compacting, cutting, or otherwise shaping the cured binder-substrate composite. In additional embodiments, the processing operation 330 may include applying a facer or other coating to the cured binder-substrate composite. In yet further embodiments, the processing operation 330 may include packaging the cured binder-substrate composite.

In embodiments, the final binder-substrate composite may be one or more of fiberglass insulation batts, mats, liners, wraps, and boards, among other articles. In additional embodiments, the final binder-substrate composite may be one or more of building insulation, pipe insulation, appliance insulation, HVAC insulation, office partitions, particle board, and fiber board, among other articles.

Figure 4:
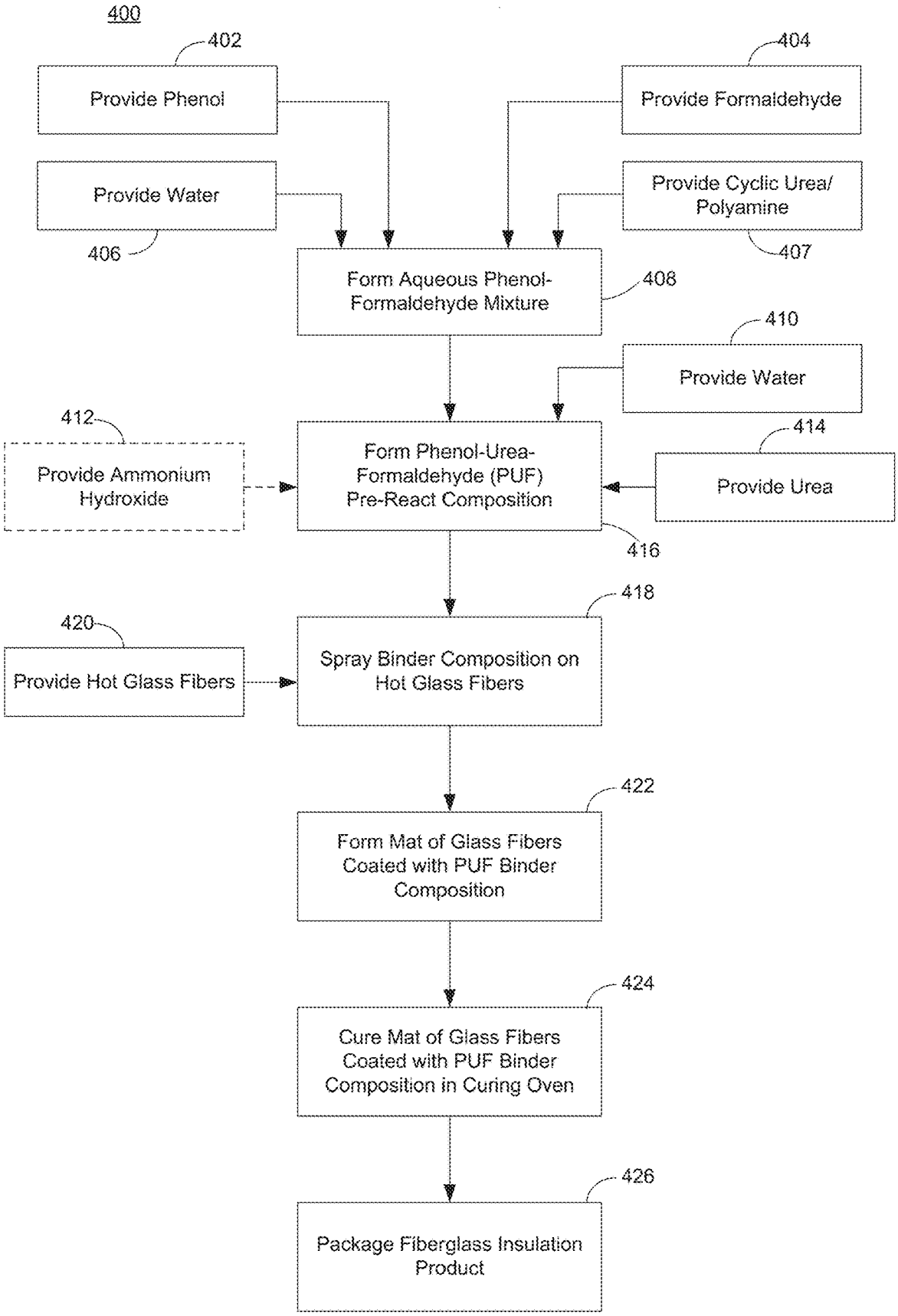
FIG. 4 is a flowchart showing selected components and operations in a method of making a fiberglass insulation product according to additional embodiments of the present technology.

FIG. 4 is a flowchart that highlights at least some of the operations in a method 400 of making a fiberglass product according to additional embodiments of the present technology. The method 400 starts by providing phenol 402, formaldehyde 404, and water 406 to form an aqueous phenol-formaldehyde mixture 408. A mixture of a cyclic urea-dialdehyde compound and a polyamine compound 407 may also be added as part of the aqueous phenol-formaldehyde mixture. As noted above, the cyclic urea-dialdehyde and polyamine compounds 407 may act as formaldehyde scavengers and crosslinkers in the binder composition and cured binder. In embodiments, the cyclic urea-dialdehyde may include 4,5-dihydroxyimidazoldin-2-one, and the polyamine compound may include dicyandiamide or melamine.

The phenol and the formaldehyde may be provided such that they form the phenol-formaldehyde mixture with a formaldehyde-to-phenol molar ratio of about 1.2:1 to about 4.5:1 (e.g., a molar ratio range of 1.5:1 to 2.5:1). The relative quantities of the phenol, formaldehyde, water, and catalyst, may be combined to form the mixture with, for example, a total solids content of about 30 to 60 wt. % of the total weight of the mixture. Another exemplary range is a total solids content of 40 to 50 wt. %.

The phenol-formaldehyde mixture may be formed at an elevated temperature such as 60° C. to 90° C. The pH of the mixture becomes alkaline (e.g., pH ranging from 7 to 9) in those embodiments that include the cyclic urea-dialdehyde and polyamine mixture 407 in the aqueous phenol-formaldehyde mixture. For example, when the cyclic urea-dialdehyde catalyst is 4,5-dihydroxyimidazoldin-2-one, the pH of the phenol-formaldehyde mixture normally ranges from 7.5 to 8.5. The cyclic urea-dialdehyde and polyamine mixture 407 may be added at 10 wt. % to 50 wt. % of the total solids in the aqueous phenol-formaldehyde mixture. The aqueous mixture may maintain this temperature for 1 minute to 10 hours before more components are added.

Once the mixture has homogenized, urea may be provided to it 410, and optionally ammonium hydroxide may also be provided 412, in addition to more water 414. These additional components transform the original phenol-formaldehyde mixture into a phenol-urea-formaldehyde (PUF) pre-react composition 416. The urea may be added in quantities that bring the weight percentage of the urea relative to the phenol-formaldehyde in the range of 15 wt. % to 50 wt. % (e.g., 20 wt % to 40 wt. %). Additional examples include a so-called "70/30" PUF pre-react composition that has about 70 wt. % phenol-formaldehyde and 30 wt. % urea based on the total weight of the phenol-formaldehyde and urea.

One or more cyclic urea-dialdehyde compounds may be added with or after the urea that forms the PUF pre-react composition. In some embodiments, the cyclic urea-dialdehyde and polyamine compounds are added to a PUF pre-react composition. The cyclic urea-dialdehyde and polyamine compounds may be added in quantities that make up a significant weight percentage of the PUF pre-react composition on a total solids basis. Exemplary ranges for the amount of the urea-dialdehyde and polyamine compounds in the PUF pre-react composition may include 10 wt. % to 50 wt. % of the total solids in the PUF pre-react composition. Additional exemplary minimum weight percentages may include 15 wt. %, 20 wt. %, 25 wt. %, 30 wt. %, 35 wt. %, 40 wt. %, and 45 wt. %, with the high end of the range at around 50 wt. % based on the total solids in the PUF pre-react composition.

The additional water may be provided to adjust the final concentration of the components of the PUF pre-react composition. Exemplary total solids range for the PUF pre-react composition includes 30 to 60 wt. %, 30 to 50 wt. %, and 40 to 50 wt. % of the total weight of the composition.

The pH of the starting phenol-formaldehyde mixture is maintained or slightly decreases with the addition of the urea, urea-dialdehyde, and polyamine compounds to make the PUF pre-react composition. Exemplary pH ranges for the PUF pre-react composition include 7.0 to 9.0 (e.g., 7.5 to 8.5). These initial reactions may also be facilitated by heating the PUF pre-react composition above room temperature. An exemplary temperature range for the PUF pre-react composition includes about 40° C. to about 50° C. The PUF pre-react composition may react at ambient temperature (20-25° C.) or an elevated temperature range (e.g., 40-50° C.) for a period of time ranging from 1 to 12 hours. Additional exemplary time ranges include 2-6 hours, and 8-12 hours, among other ranges.

The PUF pre-react composition may be introduced to a binder table that is also being fed by water and any additional components of the final binder composition. Those additional components may include one or more of a mineral or organic oil to promote dust control of the glass fibers, additional catalysts, additional pH modifiers, coupling agents, such as silane coupling agents, that promote the adhesion of the binder to the glass fibers, thickeners and rheology control agents, coloring agents, and fire retardant agents, among other additional components. The water, PUF pre-react composition, and additional components may be combined under mixing conditions in the binder table to form the binder composition. A total solids concentration of the final binder composition may range from 1 wt. % to 25 wt. % based on the total weight of the binder composition. Additional exemplary ranges include 3 wt. % to 15 wt. %, 10 wt. % to 20 wt. %, and 12 wt. % to 15 wt. %.

The binder composition, which is made at least in part from the PUF pre-react composition, is sprayed on hot glass fibers 418. The hot glass fibers may be provided 320 by a rotating spinner disc that pushes molten glass through rows of tiny orifices in the disc's sidewalls to form the hot glass fibers. A series of nozzles circularly arranged around the hot fibers emerging from the spinner disc spray the binder composition onto the falling glass fibers before they settle on a moving conveyor belt to form a raw mat of fibers coated with the binder composition 422. The volume of binder composition passing through the spray nozzles may be set to produce a target level of binder in the fiberglass product. Exemplary binder levels in the fiberglass product may include 2 wt. % to 25 wt. % (e.g., 2 wt. % to 5 wt. %; 5 wt. % to 10 wt. %; and 15 wt. % to 25 wt. %) as measured by a standard Loss-On-Ignition (LOI) analysis. The heat of the glass fibers evaporates a portion of the water and other volatile compounds from the binder composition, as well as promote the further polymerization of the phenol-formaldehyde-urea compounds as well as crosslinking them with the one or more urea-dialdehyde and polyamine compounds. In some embodiments, air is blown through the conveyor belt and mat to promote the removal of the water and other volatile compounds from the mat.

The conveyor belt transports the raw mat of fibers and binder composition to a curing oven where the binder composition is more completely cured 424 and additional water and other volatile compounds are removed from the curing fiberglass insulation. The oven temperature may be set to heat the raw mat of fibers and binder composition to a peak curing temperature of about 200° C. (392° F.) to about 260° C. (500° F.). The mat may pass through the curing oven over a period of about 1 minute to 15 minutes. Additional oven curing times may range from about 1.5 minutes to about 2 minutes, and about 5 minutes to 10 minutes.

The cured fiberglass insulation mat emerging from the curing oven may be packaged into a fiberglass insulation product 426. Exemplary products include fiberglass insulation batts, mats, liners, wraps, and boards for a variety of purposes, including building insulation, pipe insulation, appliance insulation, HVAC insulation, and office partitions, among other purposes.

EXPERIMENTAL

Phenol-urea-formaldehyde binder compositions were prepared with a variety of formaldehyde scavengers. In one experiment, the cure temperatures of the binder compositions were measured. In another experiment, formaldehyde emissions were measured from both the curing binder compositions and the post-cured binders. In still another experiment, the tensile strength of the cured binders were measured. In an additional experiment, infrared spectra were taken of the cured binders that showed the incorporation of cyclic urea-dialdehyde and polyamine compounds into the phenol-urea-formaldehyde backbone polymer of a cured binder.

The binder compositions included a phenol-urea-formaldehyde having a weight ratio of phenol-formaldehyde to urea of 65 wt. % to 35 wt. %. The aqueous phenol-formaldehyde composition was pre-reacted with an aqueous urea composition for six hours. A control binder composition was made of the pre-reacted PUF without additional formaldehyde scavengers. Five additional binder compositions were also made that included combinations of the pre-reacted PUF binder composition and one or two formaldehyde scavengers. In a first experiment, the cure temperatures of each binder composition was measured and recorded in Table 1 below:

TABLE 1

Cure Temperatures of Binder Compositions

| Binder Composition | Cure Temperature (° C.) |
|---|---|
| PUF Control Binder | 172° C. |
| PUF + 5 wt. % DICY[1] | 180° C. |
| PUF + 20 wt. % DHEU[2] | 176° C. |
| PUF + 15 wt. % DHEU + 5 wt. % DICY | 175° C. |
| PUF + 5 wt. % Melamine | 176° C. |
| PUF + 15 wt. % DHEU + 5 wt. % Melamine | 175° C. |

[1]DICY = dicyandiamide
[2]DHEU = dihydoxyethylene urea

The cure temperatures in Table 1 demonstrate that incorporated dicyandiamide as the sole formaldehyde scavenger (i.e., 5 wt. % DICY) slows cure kinetics and increases the cure temperature of a PUF binder composition. However when the same level of dicyandiamide is combined with dihydroxyethylene urea (i.e., 15 wt. % DHEU) the cure kinetics are significantly faster and the cure temperature is reduced to approximately the cure temperature of the control binder composition.

In another experiment, formaldehyde emissions were measured from both the curing binder compositions and the post-cured binders. The measured formaldehyde emissions (in part-per-billion of air) were recorded for the same six binder compositions in Table 2 below:

TABLE 2

Formaldehyde Emissions from Binder Compositions and Binders

| Binder Composition | Emission During Cure (ppb) | Emission Post-Cure (ppb) |
|---|---|---|
| PUF Control Binder | 51 | 35 |
| PUF + 5 wt. % DICY | 61 | 13 |
| PUF + 20 wt. % DHEU | 42 | 16 |
| PUF + 15 wt. % DHEU + 5 wt. % DICY | 37 | 9 |
| PUF + 5 wt. % Melamine | 28 | 14 |
| PUF + 15 wt. % DHEU + 5 wt. % Melamine | 24 | 15 |

The emissions data in Table 2 demonstrate that the combination of dicyandiamide and dihydroxyethylene urea suppressed formaldehyde emissions to a greater extent than either formaldehyde scavenger did individually. The synergetic reduction in formaldehyde emissions from the combination of the scavengers also held for the post-cure binder at a sampling low of 9 ppb. The data from Tables 1 and 2 show that the combination of dicyandiamide and dihydroxyethylene urea produced an increase in the suppression of formaldehyde emissions from a PUF binder composition without significantly slowing the compositions cure kinetics and raising its cure temperature. The data also show that formaldehyde scavenger combinations of melamine and DHEU can provide a synergistic reduction in formaldehyde emissions from PUF binder compositions and cured binders.

In still another experiment, the unaged and humid-aged tensile strengths of the cured binders were measured. The tensile strengths (in megapascals (MPa)) were measured using glass bead, dogbone composites of the cured binders, and the results were recorded in Table 3 below:

TABLE 3

Tensile Strength of Cured Binders

| Binder Composition | Unaged Tensile Strength (MPa) | Aged Tensile Strength (MPa) |
|---|---|---|
| PUF Control Binder | 3.7 MPa | 3.1 MPa |
| PUF + 5 wt. % DICY | 4.0 MPa | 3.3 MPa |
| PUF + 20 wt. % DHEU | 3.3 MPa | 2.4 MPa |
| PUF + 15 wt. % DHEU + 5 wt. % DICY | 3.7 MPa | 2.8 MPa |
| PUF + 5 wt. % Melamine | 4.0 MPa | 2.0 MPa |
| PUF + 15 wt. % DHEU + 5 wt. % Melamine | 4.3 MPa | 2.3 MPa |

The tensile strength data in Table 3 demonstrate that the combinations of dicyandiamide and dihydroxyethylene urea did not significantly reduce the tensile strength of the cured binder compared to other PUF formulations that included formaldehyde scavengers. Thus, the combination of data in Tables 1-3 show that the combination of dicyandiamide and dihydroxyethylene urea produced an increase in the suppression of formaldehyde emissions from a PUF binder composition without significantly raising its cure temperature or reducing the cured binder's tensile strength.

In an additional experiment, infrared spectra were taken of cured binders prepared from binder composition Samples #1-3 described in Table 4 below:

TABLE #4

Phenol-Urea-Formaldehyde Binder Samples #1-3

| Sample Number | Binder Composition |
|---|---|
| #1 | PUF Control Binder |
| #2 | PUF + 5 wt. % DICY |
| #3 | PUF + 5 wt. % DICY + 10 wt. % DHEU |

Figure 5A:
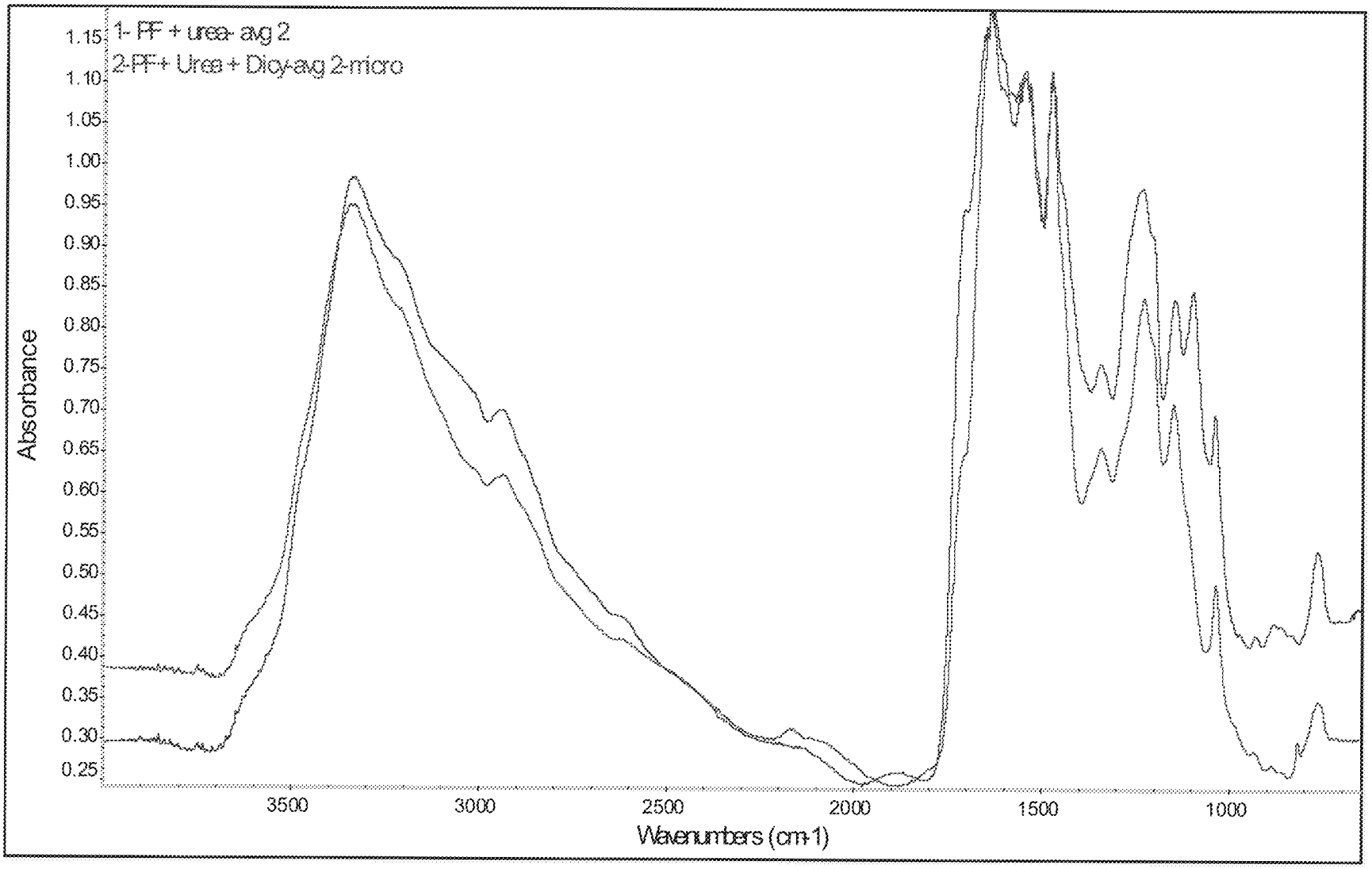
FIG. 5A and FIG. 5B show FTIR spectra of samples of cured binders according to embodiments of the present technology.
Figure 5B:
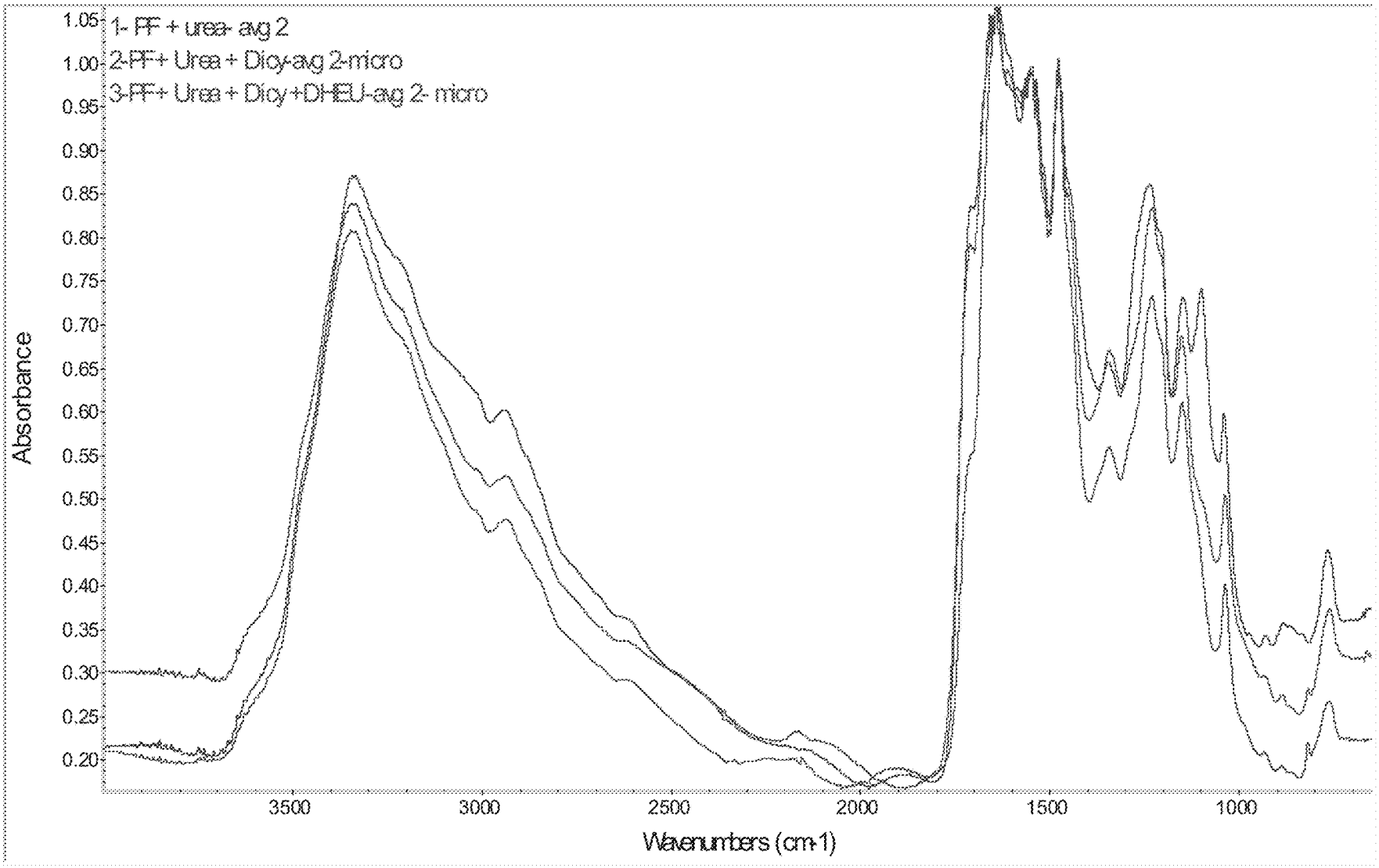

Infrared spectra of Samples #1-3 were taken at a wavenumber range of 4000 $cm^{-1}$ to 750 $cm^{-1}$ with a Nicolet 6700 FTIR spectrometer. FIG. 5A shows the FTIR spectra of Samples #1 and #2, and FIG. 5B shows the FTIR spectra of all three Samples #1-3. In FIGS. 5A-B, there is a peak in the spectra of Samples #2 and #3 at 2170 $cm^{-1}$ that is missing from the spectra of Sample #1. This peak is believed to be related to a nitride functionality of a DICY compound that has been incorporated (i.e., covalently bonded) into the PUF backbone polymer. Also in FIGS. 5A-B, the peak in the spectra of Sample #1 at 1080 $cm^{-1}$ has almost disappeared in the spectra of Samples #2 and #3. This peak is believed to be related to a vibration in the primary alcohol of methylol functionalities that remain unreacted in the PUF control binder (Sample #1) but react with DICY and DHEU in Samples #2 and #3. Further in FIGS. 5A-B, the peaks in the spectra of Samples #2 and #3 at 1120 cm-1 and 1020 cm-1 that are significantly lower than those peaks in Sample #1. This is believed to be caused by the reaction of DICY and DHEU with methylol functionalities in the PUF backbone polymer that would otherwise remain unreacted or form reversible ether linkages from phenol-phenol and phenol-urea reactions.

The FTIR spectra show that the DICY and DHEU react with the PUF backbone polymer and become incorporated into the cured binder. Among other benefits, the reactions further reduce the number of reversible ether linkages formed by the reaction of methylol functionalities with each other in the PUF backbone polymer. Over time, at least a portion of these reversible ether linkages revert back to a methylene group and free formaldehyde that can be released from the cured binder. The reactions of the DICY and DHEU with the PUF backbone polymer reduce the number of reversible ether linkages in the cured polymer that can ultimately release free formaldehyde from the cured binder. In embodiments, the DICY and DHEU that react with the PUF backbone polymer retain their reactive nitrogen functionalities and use those functionalities to scavenge additional free formaldehyde in the cured binder.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology. Additionally, methods or processes may be described as sequential or in steps, but it is to be understood that the operations may be performed concurrently, or in different orders than listed.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included.

As used herein and in the appended claims, the singular forms "a", "an", and "the" include plural references unless the context clearly dictates otherwise. Thus, for example, reference to "a compound" includes a plurality of such compounds, and reference to "the group of fibers" includes reference to one or more groups of fibers and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. A binder composition comprising:

at least one formaldehyde-containing compound;

a cyclic urea-dialdehyde compound; and a polyamine compound selected from melamine and dicyandiamide, wherein a weight ratio of the at least one formaldehyde-containing compound to the combined weight of the cyclic urea-dialdehyde compound and the polyamine compound is greater than or about 1:1, wherein a weight percentage ratio of the cyclic urea-dialdehyde compounds to the polyamine compounds in the binder composition is 50:50 or less, and wherein the polyamine is added to the binder composition before curing.

2. The binder composition of claim 1, wherein the at least one formaldehyde-containing compound is selected from the group consisting of phenol formaldehyde, urea formaldehyde, phenol-urea-formaldehyde, melamine formaldehyde, melamine-urea-formaldehyde, and resorcinol-formaldehyde.

3. The binder composition of claim 1, wherein the cyclic urea-dialdehyde compound has the formula:

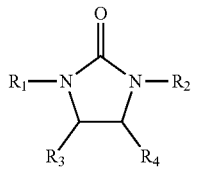

wherein $R_1$ and $R_2$ are independently selected from a hydrogen, a hydroxyl group, and an alcohol group, and wherein $R_3$ and $R_4$ are independently selected from a hydroxyl group and an alcohol group.

4. The binder composition of claim 3, wherein the cyclic urea-dialdehyde compound comprises 4,5-dihydroxyimidazoldin-2-one.

5. The binder composition of claim 1, the polyamine compound comprises dicyandiamide.

6. The binder composition of claim 1, wherein the binder composition further comprises a cure catalyst selected from diammonium sulfate and diammonium phosphate.

7. The binder composition of claim 1, the binder composition is characterized by a free formaldehyde level of less than or about 11 wt. % based on a total weight of the binder composition.

8. The binder composition of claim 1, wherein the binder composition is characterized by a pH of greater than or about 8.

9. The binder composition of claim 1, wherein the weight percentage ratio of the cyclic urea-dialdehyde compounds to the polyamine compounds in the binder composition is 25:75 or less.

10. A binder-containing fiberglass product comprising:

glass fibers; and a binder, wherein the binder comprises a formaldehyde-containing polymer characterized by crosslinking with a cyclic urea-dialdehyde and a polyamine, wherein the polyamine is a polyamine compound selected from melamine and dicyandiamide;

wherein a weight ratio of the at least one formaldehyde-containing compound to the combined weight of the cyclic urea-dialdehyde compound and the polyamine compound is greater than or about 1:1, wherein the polyamine is added to the binder composition before curing; and wherein a weight percentage ratio of the cyclic urea-dialdehyde compounds to the polyamine compounds in the binder composition is 50:50 or less.

11. The product of claim 10, wherein the formaldehyde-containing polymer comprises a phenol-urea-formaldehyde polymer.

12. The product of claim 10, wherein the cyclic urea-dialdehyde comprises 4,5-dihydroxyimidazoldin-2-one.

13. The product of claim 10, wherein the polyamine comprises dicyandiamide.

14. The product of claim 10, wherein the product is characterized by a 23° C. formaldehyde emissions of less than or about 20 part-per-billion.

15. The product of claim 10, wherein the product is characterized by a tensile strength of greater than or about 3.3 MPa.

* * * * *